US006145466A

United States Patent [19]

Herbein et al.

[11] Patent Number: 6,145,466

[45] Date of Patent: Nov. 14, 2000

[54] BOAT MANUFACTURED FROM FORMABLE ALUMINUM

[75] Inventors: William C. Herbein, Murrysville, Pa.; Daniel D. Roup, Davenport; Robert B. Whitesides, Bettendorf, both of Iowa

[73] Assignee: Alcoa Inc., Pittsburgh, Pa.

[21] Appl. No.: 09/186,828

[22] Filed: Nov. 5, 1998

Related U.S. Application Data

[60] Provisional application No. 60/064,253, Nov. 4, 1997.

[51] Int. Cl.[7] ..... B63B 3/00

[52] U.S. Cl. ..... 114/356

[58] Field of Search ..... 114/355, 356, 114/357

[56] References Cited

U.S. PATENT DOCUMENTS

| | | | |
|---|---|---|---|
| 3,327,219 | 6/1967 | Johnson et al. | 114/356 |
| 5,349,917 | 9/1994 | May | 114/356 |
| 5,676,080 | 10/1997 | Allen | 114/356 |

*Primary Examiner*—Stephen Avila
*Attorney, Agent, or Firm*—Charles Q. Buckwalter

[57] ABSTRACT

The present invention is directed to the enabling formability of the 6000 series alloys for the manufacture of small to medium sized water vessels.

18 Claims, 2 Drawing Sheets

BOAT MANUFACTURED FROM FORMABLE ALUMINUM

CROSS REFERENCE TO RELATED APPLICATIONS

This application claims the benefit of U.S. Provisional Application Serial No. 60/064,253, filed Nov. 4, 1997.

FIELD OF THE INVENTION

The present invention is directed to the manufacture of small to medium sized water craft from formable aluminum alloys especially those comprising the 6000 series aluminum alloys as designated by the Aluminum Association in combination with a sandwich construction method to create a highly stylized structure at lower costs than available under the boat current technology.

BACKGROUND OF THE INVENTION

The manufacture of boats from aluminum is old in the boat building business. Aluminum is found to be a useful resource for water vehicles since it is light weight, strong, and weatherable. Neither salt nor fresh bodies of water have much impact on the durability of aluminum, thereby making aluminum a preferred material over ironbased materials, such as steel, the added weight of steel notwithstanding. Aluminum is preferred over wood-based materials since rotting is not an issue; and due to the strength of aluminum, the hulls can be made thinner, thereby making the vessel lighter than a wooden structure. Aluminum is preferred over fiberglass in instances where the boat will see rugged service such as in fishing boats. However, the dominate material for recreational boats is fiberglass due to the ability to create highly stylized designs at low cost. Fiberglass boats incorporate hull and deck designs with a high degree of contours which present aluminum boat technology could not affordably replicate. Fiberglass has a disadvantage due to the caustic nature of the chemicals used to make the material and the resulting pollution from the waste chemicals.

Aluminum alloys tend to have limited ductility therefore making formability difficult, thereby making aluminum a less desirable building material when forming is a priority. One only has to recall the past designs of aluminum boats, such as the squared off front-end boats, to conjure up Edsel-type design nightmares which can result in economic failures. When forming aluminum alloys, micro and macro cracks can be made which inhere to the boat hull. This can result in weaknesses within the hull that can ultimately result in leakage and water intrusion to the interior of the boat, which is, quite obviously, an undesirable characteristic for a boat hull.

The present invention provides the opportunity to significantly expand on boat hull designs made from aluminum for small to medium size water vessels. The invention, which is comprised of a plurality of technologies, enables the creation contours and styling in an aluminum recreational boat at a cost never before available. This low cost highly stylized aluminum boat will offer a consumer a rugged, highly stylized boat which is much lighter than fiberglass boats. The light weight provides considerable savings on propulsion systems when compared to boats constructed of fiberglass. The weight advantage of the present invention eases the trailering requirement often associated with recreational water craft.

A preferred manufacture are pleasure boats within the 15 to 40 foot length from bow to stern, but most preferred is the manufacture of pleasure craft in the 17 to 26 foot length. Pleasure craft can, of course, take many forms; from speed boats, row boats, crew boats, canoes, kayaks, simple motor boats and fishing boats, to the more exotic jet skis, di- and tri-hulled schooners or catamarans, and platforms.

Figure 1:
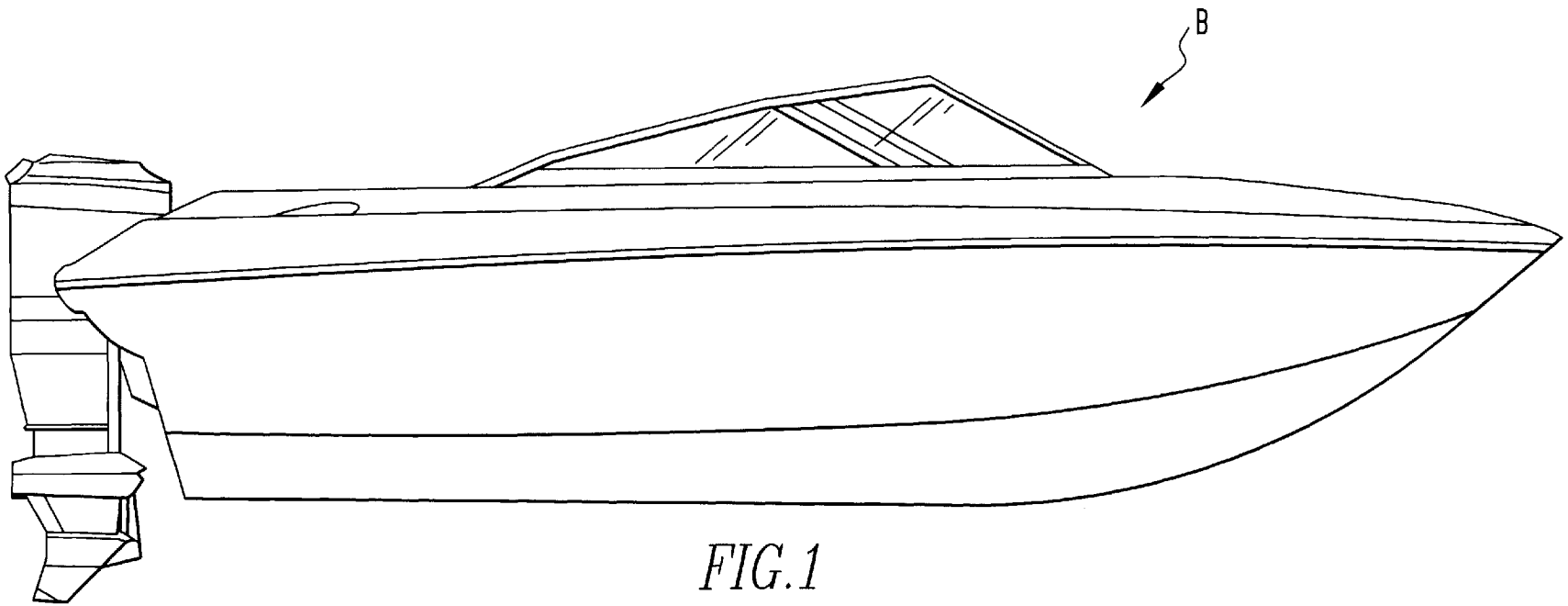
FIG. 1 shows the formability of the preferred alloy incorporated in a small pleasure craft.

What has been found by the present invention is that 6000 series alloys, especially 6022 alloy, comprise the kind of formability that can make interesting and useful boat hull designs without foregoing all of the advantages which reside in the properties of aluminum alloy materials. An example of such a design is shown for the boat B of FIG. 1.

SUMMARY OF THE INVENTION

The manufacture of the inventive boat is comprised of a mixture of materials, the most important of which is the enabling formability of the 6000 series aluminum alloy. The hull of the boat is manufactured of a thin gauge, high strength tempered alloy which can then be aged at elevated temperatures after forming to achieve a high yield strength of greater than 40 ksi. This minimum yield strength allows the use of thinner hulls than are currently used in pleasure and commercial vessels.

When manufacturing the shape of the hull, conveniently, a stretch forming process is used. Stretch forming means that the aluminum alloy is clamped into a stretcher and extended anywhere from 1 to 15% of its original manufactured length. Current aluminum recreational boats are produced from 5052 aluminum alloy. Stretch forming this alloy will create surface defects known as lueders which are aesthetically rejectionable and therefore commercially unviable. Alloy 6022 does not lueder in the stretch forming operation. The performance of the alloy in stretch forming is an important enabler for a highly stylized and useful aluminum recreational boat. The hulls of this invention are stretch formed and then artificially aged at low temperatures up to their final properties.

Hydroforming may be used to shape a one-piece alloy transom. The forming may be done in a temper, such as T4 or O, and the thusly-formed part is then aged at an elevated temperature with the aluminum alloy hull. Aging together provides a mating of similar strength and form between the transom and the hull.

Figure 2:
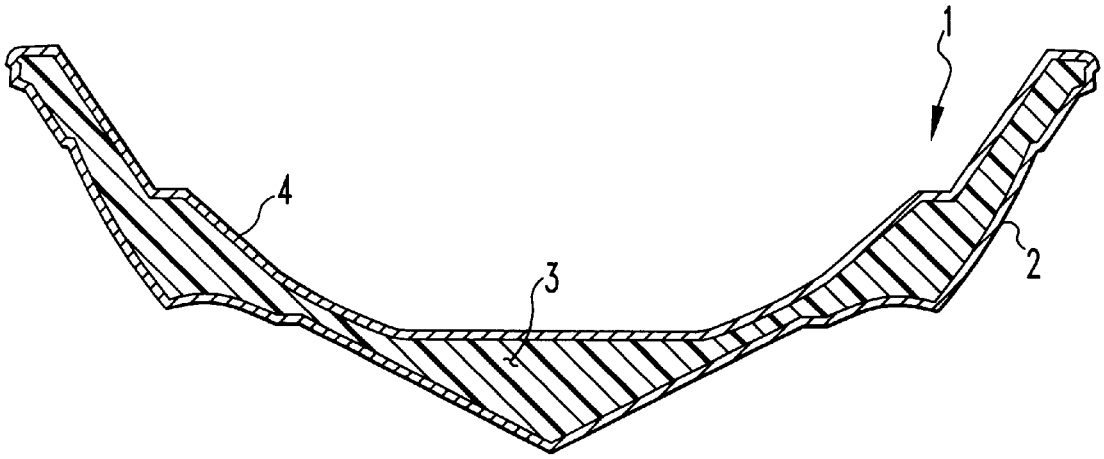
FIG. 2 shows a cross-section of the sandwich construction.

Stiffness is important in boat hull manufacture. The perception that a boat is rugged and sound is based on the intuitive feel of rigidness in the hull structure. Prior aluminum recreational boats created the rigidity in the structure through the use of a frame assembled from several aluminum extrusions and rolled sections. The cost in material and assembly labor for the frame is roughly 40% of structure cost. In this invention, stiffness is achieved by making a sandwich structure of the outer alloy hull, inner aluminum liner with a polymer material sandwiched between the hull and liner, as shown in FIG. 2. In FIG. 2 the exterior portion 2 of the hull 1 is manufactured from 6022 alloy, the interior portion 4 the same or some other aluminum alloy or perhaps a polymer sheet. The inner portion 3 between 1 and 4 can be a polymer material. The polymer material, such as a polyurethane foam, can be used to maintain a separation of the sandwich layers or to extend the metaphor, is the filling between the bread. In this way the inner and outer hull communicate through the filling. Embedded stiffeners in the hull may be optionally employed to add stiffness to the hull structure. Polymer materials may comprise any of the well-known organic polymers such as by way of example the polyethylenes, polypropylenes, polyimides, styrofoam, and the vast amount of copolymers known to those in the polymer art in sheet, foam, bead, or some other convenient form. Polyurethane is the most preferred of the polymer family in a foamed form.

In its most preferred embodiment, 6022 alloy of a thin gauge, from 1 to 100 mils, preferably 25 to 50 mils, is formed in the T4 temper and aged at elevated temperatures to provide a yield strength which is greater than 30 ksi, more preferably 40 ksi, to form the hull material. The same 6022 alloy material is hydroformed to manufacture a transom. The formed transom is fabricated in a T4 temper. Both the hull and the transom are then aged at an elevated temperature ranging from 300° to 500° F., preferably from about 350° to about 400° F. for from about 30 to 60 minutes, but can be aged longer. Other tempers, such as T6, may be employed, but T4 is the preferred temper for formability.

The putative composition of the most preferred 6022 alloy comprises in weight percent about 0.8 to 1.5 silicon, 0.05 to 0.20 iron, 0.01 to 0.11 copper, 0.02 to 0.10 manganese, 0.45 to 0.7 magnesium, no more than 0.10 chromium, no more than 0.25 zinc, and no more than about 0.15 titanium, the remainder aluminum and incidental impurities. Variations of this most preferred composition can be made within the 6000 series alloys with advantageous effects for the import of the present invention in its aspect for formability and design.

An important feature of the application of the 6022 alloy for boat manufacture is its aging at elevated temperatures. This property provides for the simultaneous curability of paints and other surface treatments which enable the inventive aluminum alloy boats to appear other than as aluminum looking boats. Accordingly, thin layers of paint can be cured during the aging of the alloy resulting in the aforementioned increase in yield strength.

The 6022 alloy is a non-luedering alloy which means that the surface of the alloy will maintain a commercial visage after it has been worked, such as by stretching. As a result, stretch forming processes add strength and increase the opportunity for piece count reduction and more design options in shaping the hull surface with fewer joints, connections, and sealants.

We claim:

1. A boat comprising:

a complete outer hull, a complete inner hull and an intermediate layer disposed between said inner and outer hulls, each of said outer hull and said inner hull comprising age hardened stretched aluminum alloy and said intermediate layer comprising a polymer material.

2. The boat as claimed in claim 1 wherein said stretched aluminum alloy is an Aluminum Association 6000 series alloy.

3. The boat as claimed in claim 2 wherein said stretched aluminum alloy is Aluminum Association alloy 6022.

4. The boat as claimed in claim 1 wherein said polymer material is selected from the group consisting of polyurethane foam, polyethylene, polypropylene, polyimide, and styrofoam.

5. The boat as claimed in claim 1 wherein said stretched alloy is stretched by about 1% to about 15%.

6. The boat as claimed in claim 1 wherein said stretched alloy has a temper of T4, T6 or O.

7. The boat as claimed in claim 6 wherein said stretched alloy has a minimum yield strength of 30 ksi.

8. The boat as claimed in claim 1 wherein each of said outer hull and said inner hull has a thickness of about 1 to about 100 mils.

9. The boat as claimed in claim 1 further comprising a transom formed of hydroformed aluminum alloy.

10. The boat as claimed in claim 9 wherein said hydroformed aluminum alloy is an Aluminum Association 6000 series alloy.

11. The boat as claimed in claim 1 wherein said stretched alloy is age hardened.

12. The boat as claimed in claim 9 wherein said hydroformed alloy is age hardened.

13. A method of manufacturing a boat comprising the steps of:

a) providing two sheets of formable aluminum;

b) stretch forming one of the sheets into a shape of an outer boat hull;

c) stretch forming the other of the sheets into a shape of an inner boat hull;

d) aging the outer boat hull and the inner boat hull at a temperature of about 300° F. to about 500° F.; and e) inserting a layer of a polymer material between the outer boat hull and the inner boat hull.

14. The method of manufacturing a boat as claimed in claim 13 further comprising prior to step d), a step of hydroforming a transom from formable aluminum alloy and wherein step d) further includes simultaneously aging the transom, the outer boat hull and the inner boat hull.

15. The method of manufacturing a boat as claimed in claim 13 wherein said steps b) and c) stretch the sheets by about 1% to about 15%.

16. The method of manufacturing a boat as claimed in claim 13 wherein the aluminum alloy is an Aluminum Association 6000 series alloy.

17. The method of manufacturing a boat as claimed in claim 16 wherein the aluminum alloy is Aluminum Association alloy 6022.

18. The method of manufacturing a boat as claimed in claim 17 wherein step d) hardens the alloy to a temper of T6.

* * * * *